US012523008B2

(12) United States Patent
Carton

(10) Patent No.: US 12,523,008 B2
(45) Date of Patent: Jan. 13, 2026

(54) ELECTRIC WORK VEHICLE

(71) Applicant: Yanmar Holdings Co., Ltd., Osaka (JP)

(72) Inventor: Alexandre Carton, Saint-Dizier (FR)

(73) Assignee: YANMAR HOLDINGS CO., LTD., Osaka (JP)

( * ) Notice: Subject to any disclaimer, the term of this patent is extended or adjusted under 35 U.S.C. 154(b) by 430 days.

(21) Appl. No.: 17/943,642

(22) Filed: Sep. 13, 2022

(65) Prior Publication Data

US 2024/0018744 A1 Jan. 18, 2024

(30) Foreign Application Priority Data

Jul. 15, 2022 (EP) ..... 22315154

(51) Int. Cl.
*E02F 9/08* (2006.01)
*E02F 9/20* (2006.01)
*E02F 9/22* (2006.01)

(52) U.S. Cl.
CPC ..... *E02F 9/0866* (2013.01); *E02F 9/207* (2013.01); *E02F 9/226* (2013.01)

(58) Field of Classification Search
CPC ..... E02F 9/0866; E02F 9/207; E02F 9/226; E02F 3/325; E02F 9/0883; E02F 3/964; E02F 9/0808; E02F 9/0858; E02F 9/2091; E02F 9/2095; E02F 9/2228; E02F 9/2235; E02F 9/2246; E02F 9/2278; B60K 11/02; F15B 15/18
USPC ..... 180/68.5
See application file for complete search history.

(56) References Cited

U.S. PATENT DOCUMENTS

| | | | | |
|---|---|---|---|---|
| 10,066,358 | B2 * | 9/2018 | Ota | F02B 63/04 |
| 2017/0226715 | A1 * | 8/2017 | Ota | B60K 6/40 |
| 2023/0131436 | A1 * | 4/2023 | Kitahara | E02F 9/2095 60/420 |
| 2023/0417019 | A1 * | 12/2023 | Kitahara | E02F 9/207 |
| 2024/0018744 | A1 * | 1/2024 | Carton | E02F 9/207 |
| 2024/0018745 | A1 * | 1/2024 | Carton | E02F 9/0883 |

(Continued)

FOREIGN PATENT DOCUMENTS

| | | | |
|---|---|---|---|
| EP | 1775392 | A2 | 4/2007 |
| EP | 3176334 | A1 | 6/2017 |
| EP | 3992010 | A1 | 5/2022 |

(Continued)

OTHER PUBLICATIONS

The Extended European Search Report for Patent App No. EP22315154.9 (dated Jan. 10, 2023).

*Primary Examiner* — James A Shriver, II
*Assistant Examiner* — Hilary L Johns
(74) *Attorney, Agent, or Firm* — Future IP LLC; Tomoko Nakajima

(57) ABSTRACT

Compactly locate an energy storage device, a cooling device, and an electric motor thereby to realize a layout preferable for a small electric work machine. A hydraulic excavator as an electric work machine includes an electric motor, an energy storage device that stores electric power to drive the electric motor, a hydraulic pump that is driven by the electric motor and discharges a hydraulic oil, an electric instrument through which a refrigerant passes, and a cooling device that cools at least one of the hydraulic oil and the refrigerant. The electric motor and cooling device are located beside the energy storage device.

13 Claims, 9 Drawing Sheets

(56) References Cited

U.S. PATENT DOCUMENTS

2024/0133156 A1* 4/2024 Muraoka ..... E02F 3/325

FOREIGN PATENT DOCUMENTS

JP 5297976 B2 6/2013
WO WO-2021173951 A1 * 9/2021 ..... B60K 1/04

* cited by examiner

ELECTRIC WORK VEHICLE

This application claims priority under 35 U.S.C. § 119 to European Patent Application No. 22315154.9, filed Jul. 15, 2022, which is incorporated by reference.

TECHNICAL FIELD

The present invention relates to an electric work machine.

BACKGROUND ART

A conventional electric work machine equipped with an electric motor has been proposed. For example, Patent Document 1 discloses a backhoe equipped with an electric motor. The above backhoe adopts a layout in which a hydraulic pump, an electric motor, and a fan for cooling (air-cooling) the above are located below a battery (energy storage device).

PRIOR ART DOCUMENT

Patent Document

Patent Document 1: Japanese Unexamined Patent Application Publication No. 2011-089369

SUMMARY OF INVENTION

Technical Problem

In order for an electric work machine to provide adequate work performance, a cooling device including a heat exchanger should be located thereby to cool at least one of a refrigerant that passes through an electric instrument (e.g., electric motor) and a hydraulic oil supplied from a hydraulic pump to a hydraulic actuator. At this time, in a small electric work machine, it is difficult to secure a large space for the arrangement of each member because of a narrow engine chamber. Therefore, when locating the above cooling device, it is preferable to locate the above cooling device and other members (e.g., energy storage device, electric motor) as compactly as possible.

In this regard, in a configuration such as the one in the Patent Document 1, where an electric motor and the like are located in the space below the energy storage device, it is difficult to further locate the above cooling device in this space because the above space is narrow. This requires the cooling device to be located in a position away from the electric motor, making it difficult to realize a compact layout preferable for the small electric work machine.

The present invention has been made so as to solve the above problem; it is therefore an object of the present invention to compactly locating an energy storage device, a cooling device, and an electric motor thereby to realize a layout preferable for a small electric work machine.

Solution to Problem

An electric work machine according to one aspect of the present invention includes: an electric motor, an energy storage device that stores electric power to drive the electric motor, a hydraulic pump that is driven by the electric motor and discharges a hydraulic oil, and an electric instrument through which a refrigerant passes, wherein the electric work machine further includes a cooling device that cools at least one of the hydraulic oil and the refrigerant, and the electric motor and the cooling device are located beside the energy storage device.

Advantageous Effects of Invention

According to the above configuration, the energy storage device, the cooling device, and the electric motor can be compactly located thereby to realize a layout preferable for a small electric work machine.

DESCRIPTION OF EMBODIMENTS

The following is a description of an embodiment of the present invention based on the drawings.

1. Electric Work Machine

Figure 1:
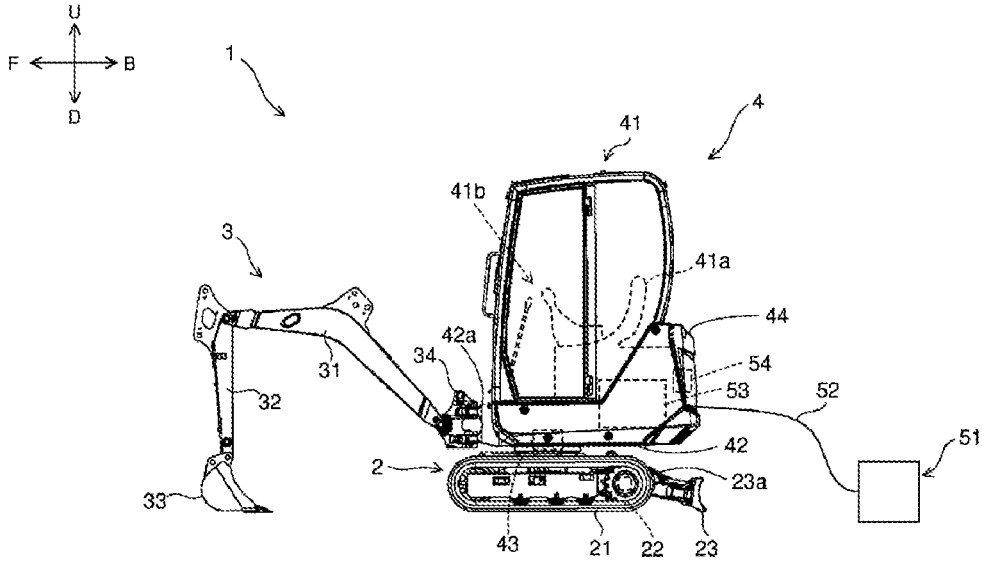
FIG. 1 is a side view showing a schematic configuration of a hydraulic excavator which is an example of an electric work machine according to an embodiment of the present invention.

FIG. 1 is a side view showing a schematic configuration of a hydraulic excavator 1 which is an example of an electric work machine according to the present embodiment. The hydraulic excavator 1 is equipped with a lower travel body 2, work instrument 3, and an upper swivel body 4.

Here, directions are defined as follows. The direction in which a man operator (pilot, driver) seated in a driver seat 41*a* of the upper swivel body 4 faces the front is forward, and the opposite direction is backward. Therefore, when the upper swivel body 4 is in a non-swivel state (swivel angle 0°) relative to the lower travel body 2, the front-back direction of the upper swivel body 4 is the same as the direction in which the lower travel body 2 moves forward and backward. Also, the left side is "left" and the right side is "right" as viewed from the man operator seated in the driver seat 41*a*. Further, the gravity direction perpendicular to the front-back and left-right directions is defined as the vertical direction, with the upstream side of the gravity direction being "up" and the downstream side being "down." In the drawing, the hydraulic excavator 1 is shown with the upper swivel body 4 in a non-swivel position relative to the lower travel body 2. In addition, in the drawings, if necessary, forward is denoted by a symbol "F", likewise, backward by "B", rightward by "R", leftward by "L", upward by "U", and downward by "D".

The lower travel body 2 is equipped with a pair of crawlers 21 on left and right and a pair of traveling motors 22 on left and right. Each of the traveling motors 22 is a hydraulic motor. The left and right traveling motors 22 drive the left and right crawlers 21, respectively, thereby to move the hydraulic excavator 1 forward and backward. The lower travel body 2 is equipped with a blade 23 and a blade cylinder 23*a* for leveling work. The blade cylinder 23*a* is a hydraulic cylinder to rotate the blade 23 in the vertical direction.

The work instrument 3 has a boom 31, an arm 32, and a bucket 33. The boom 31, the arm 32, and the bucket 33 are driven independently there to make it possible to perform excavating of earth and sand.

The boom 31, the arm 32, and the bucket 33 are rotated by an unshown boom cylinder, an unshown arm cylinder, and an unshown bucket cylinder, respectively. The boom cylinder, the arm cylinder, and the bucket cylinder are each constituted of a hydraulic cylinder.

Abase end portion of the boom 31, i.e., the end portion opposite the side connected to the arm 32 in the boom 31 is swingably connected to a head end portion 42*a* of a swivel frame 42 via a bracket 34. That is, the hydraulic excavator 1 in the present embodiment has a boom swing function in which the boom 31 swings to the left or right starting from the head end portion 42*a*.

The upper swivel body 4 is located above the lower travel body 2 and can be swiveled with respect to the lower travel body 2 via a swivel bearing (not shown). In the upper swivel body 4, an operating portion 41, a swivel frame 42, a swivel motor 43, an engine chamber 44, etc. are located. Being driven with the swivel motor 43 as a hydraulic motor, the upper swivel body 4 swivels via a swivel bearing.

A hydraulic pump 71 (see FIG. 2) is located in the upper swivel body 4. The hydraulic pump 71 is driven by an electric motor 61 (see FIG. 2) inside the engine chamber 44. The hydraulic pump 71 supplies hydraulic oil (pressure oil) to the hydraulic motor (e.g., left and right traveling motors 22, swivel motor 43), and the hydraulic cylinder (e.g., blade cylinder 23*a*, boom cylinder, arm cylinder, bucket cylinder). The hydraulic motor and the hydraulic cylinder that are driven with the hydraulic oil supplied from the hydraulic pump 71 are collectively referred to as a hydraulic actuator 73 (see FIG. 2).

The driver seat 41*a* is located in the operating portion 41. Various levers 41*b* are located around the driver seat 41*a*. Upon the man operator seated on the driver seat 41*a* operates the lever 41*b*, the hydraulic actuator 73 is driven. This allows the lower travel body 2 to travel, the blade 23 to perform the ground leveling work, the work instrument 3 to perform the excavation work, and the upper swivel body 4 to swivel, etc.

A battery unit 53 is located in the upper swivel body 4. That is, the hydraulic excavator 1 is equipped with the battery unit 53. The battery unit 53 is constituted of a lithium-ion battery unit, for example, and is an energy storage device that stores power to drive the electric motor 61. The battery unit 53 may be constituted of a plurality of battery cells as a unit or may be constituted of a single battery cell. A power feed port 50 (see FIG. 3) is provided at the back portion of the upper swivel body 4. The power feed port and a commercial power source 51 as an external power source are connected via a power feed cable 52. This can charge the battery unit 53.

The upper swivel body 4 is further equipped with a lead battery 54. The lead battery 54 outputs a low-voltage (e.g., 12 V) DC voltage. The output from the lead battery 54 is supplied as control voltage to, for example, a system controller 67 (see FIG. 2), a driver of a fan 92 (see FIG. 4), etc.

The hydraulic excavator 1 may be so configured as to be a combination of a hydraulic instrument such as a hydraulic actuator 73 and an actuator driven by electric power. Actuators driven by electric power include, for example, electric travel motors, electric cylinders, and electric swivel motors.

2. Configuration of Electric and Hydraulic Systems

Figure 2:
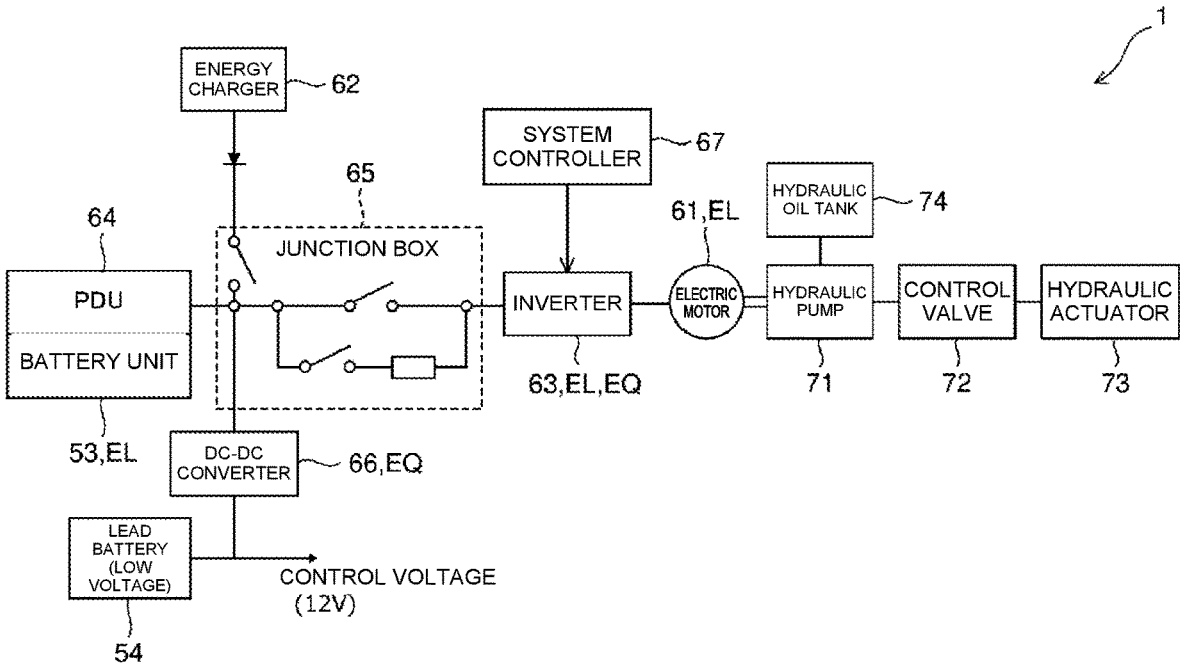
FIG. 2 is a block diagram schematically showing the electrical and hydraulic configurations of the hydraulic excavator.

FIG. 2 is a block diagram schematically showing the electric and hydraulic systems of the hydraulic excavator 1. The hydraulic excavator 1 has the electric motor 61, a charger 62, an inverter 63, a PDU (Power Distribution Unit) 64, a junction box 65, a DC-DC converter 66, and the system controller 67. The system controller 67 is constituted of an electronic control unit, also called an ECU (Electronic Control Unit), and electrically controls each part of the hydraulic excavator 1.

The electric motor 61 is driven by electric power supplied from the battery unit 53 via the junction box 65 and the inverter 63. The electric motor 61 is constituted of a permanent magnet motor or an induction motor. On the swivel frame 42, the electric motor 61 is supported by a motor support portion 100 (see FIG. 3, etc.).

Into DC voltage, the charger 62 (also called a power feeder) converts AC voltage supplied from the commercial power source 51, shown in FIG. 1, via the power feed cable 52. Into AC voltage, the inverter 63 converts the DC voltage supplied from the battery unit 53, and supplies the AC voltage to the electric motor 61. This rotates the electric motor 61. The AC voltage (current) is supplied from the inverter 63 to the electric motor 61 based on the rotation command output from the system controller 67.

The PDU 64 is a battery control unit that controls an internal battery relay thereby to control the inputting and outputting of the battery unit 53. The PDU 64 is located above the battery unit 53 (see FIG. 4).

The junction box 65 includes a charger relay, an inverter relay, a fuse, etc. The voltage output from the charger 62 is supplied to the battery unit 53 via the junction box 65 and the PDU 64. Further, the voltage output from the battery unit 53 is supplied to the inverter 63 via the PDU 64 and the junction box 65.

To a lower voltage (e.g., 12 V), the DC-DC converter 66 steps down the high-voltage (e.g., 300 V) DC voltage supplied from the battery unit 53 via the junction box 65. Like the output from the lead battery 54, the voltage output from the DC-DC converter 66 is supplied to the system controller 67, the driver of the fan 92, etc. Note that the DC-DC converter 66 may be located within the PDU 64.

A plurality of hydraulic pumps 71 are connected to the rotary shaft (output shaft) of the electric motor 61. The plurality of hydraulic pumps 71 include variable displacement and fixed displacement pumps. FIG. 2 shows one hydraulic pump 71 only as an example. Each hydraulic pump 71 is connected to a hydraulic oil tank 74. When the hydraulic pump 71 is driven by the electric motor 61, the hydraulic oil in the hydraulic oil tank 74 is supplied to the hydraulic actuator 73 via the hydraulic pump 71 and the control valve 72. This drives the hydraulic actuator 73. The control valve 72 is a direction-switching valve that controls the flow direction and flow rate of the hydraulic oil supplied from the hydraulic pump 71 to the hydraulic actuator 73.

Thus, the hydraulic excavator 1 is equipped with the hydraulic pump 71 that is driven by the electric motor 61 and discharges the hydraulic oil. Also, the hydraulic excavator 1 is equipped with the hydraulic actuator 73 driven by the hydraulic oil supplied from the hydraulic pump 71. In addition, the hydraulic excavator 1 is equipped with a hydraulic oil tank 74 that contains the hydraulic oil.

Via a piping RP, the electric instrument EL such as the battery unit 53, the electric motor 61, and the inverter 63 are connected to a radiator 91*a* (see FIG. 3) to be described below. Refrigerant supplied from the radiator 91*a* flows in the piping RP. Then, the refrigerant flowing in the piping RP passes through in the electric instrument EL. Therefore, cooling the refrigerant by heat exchange in the radiator 91*a* and supplying the refrigerant from the radiator 91*a* to the electric instrument EL can cool (water-cool) the electric instrument EL. Thus, the hydraulic excavator 1 is equipped with the electric instrument EL through which the refrigerant passes. The refrigerant is, for example, cooling water.

3. Configuration in Engine Chamber

Figure 3:
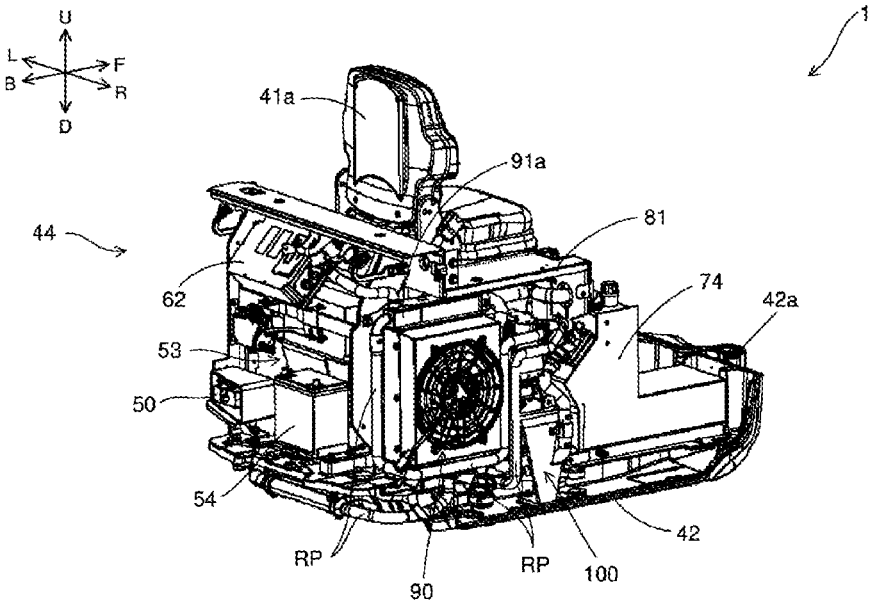
FIG. 3 is a perspective view showing an overall configuration in an engine chamber of the hydraulic excavator.

FIG. 3 is a back perspective view of the overall configuration in the engine chamber 44 of the hydraulic excavator 1. The driver seat 41*a* is located on a seat mount 81. The battery unit 53 is located between the seat mount 81 and the swivel frame 42. The battery unit 53 is located on the swivel frame 42, on the back side, and off to the left of the center in the left-right direction. In the present embodiment, two battery cells 53*a* (see FIG. 4) are vertically located alongside thereby to form one battery unit 53. The number of battery cells 53*a* constituting the battery unit 53 is not particularly limited. Behind the battery unit 53 on the swivel frame 42, the lead battery 54 and the power feed port 50 are located alongside the left-right direction. The charger 62 is located at the upper back portion of the battery unit 53.

A cooling device 90 is located to the right of the battery unit 53. That is, the hydraulic excavator 1 is equipped with the cooling device 90. The cooling device 90 is a device that cools at least one of the refrigerant and the hydraulic oil by the heat exchange.

Figure 4:
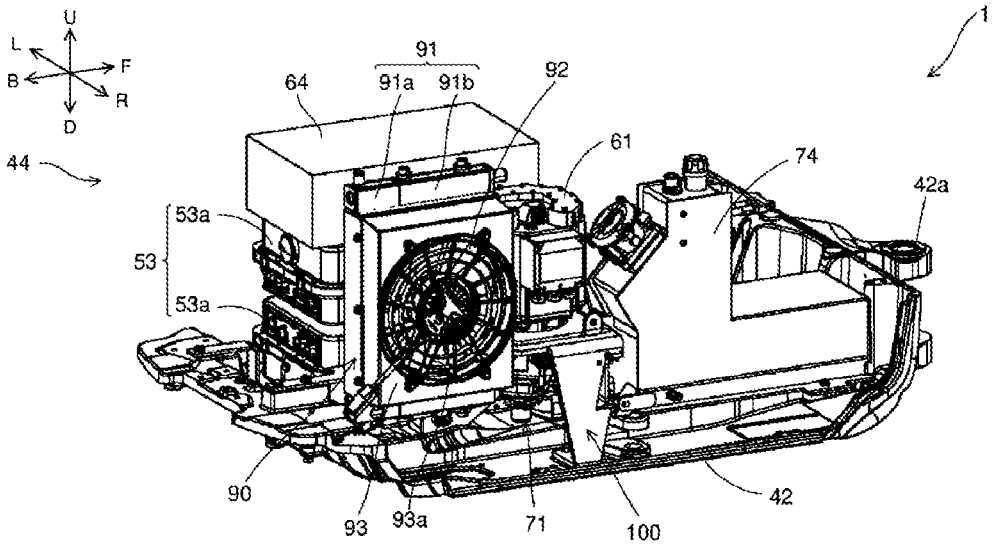
FIG. 4 is a perspective view showing a main portion in the engine chamber.

FIG. 4 is a back perspective view of the main portion in the engine chamber 44 of the hydraulic excavator 1. The cooling device 90 includes a heat exchanger 91, the fan 92, and a fan shroud 93. The heat exchanger 91 includes a radiator 91*a* and an oil cooler 91*b*. By heat exchange, the radiator 91*a* cools the refrigerant passing through the electric instrument EL. The oil cooler 91*b* is connected to an oil path circulating via the hydraulic pump 71, the hydraulic actuator 73 (see FIG. 2), etc., and, by the heat exchange, cools the hydraulic oil flowing in the oil path. The radiator 91*a* and the oil cooler 91*b* are located alongside the front-back direction. Further, the radiator 91*a* and the oil cooler 91*b* are located opposite the fan 92.

The fan 92 generates airflow across the heat exchanger 91. In the present embodiment, the fan 92 is located on the right side of the heat exchanger 91, i.e., opposite the battery unit 53 with respect to the heat exchanger 91. The fan 92 is covered with the fan shroud 93. The fan shroud 93 is a cover having an air vent 93*a*, and covers the fan 92 from the right side.

When the fan 92 is rotated, air (wind) flowing from the inside of the engine chamber 44 across the heat exchanger 91 is discharged to the outside of the hydraulic excavator 1 via the air vent 93*a* of the fan shroud 93. That is, the air flows through a gap between the radiator 91*a* and the oil cooler 91*b*. This cools the heat exchanger 91. That is, the refrigerant flowing through radiator 91*a* and the hydraulic oil flowing through the oil cooler 91*b* are cooled by the heat exchange. This type of driving the fan 92 is called a "discharging type".

The drive type of fan 92 may be a "sucking type". In the sucking type, when the fan 92 is rotated, air outside the hydraulic excavator 1 is sucked into the engine chamber 44 through the air vent 93*a* of the fan shroud 93. The air sucked in by the fan 92 flows toward the heat exchanger 91, and runs across the heat exchanger 91. This cools the heat exchanger 91.

It is allowed that the heat exchanger 91 is constituted of only one of the radiator 91*a* and the oil cooler 91*b*, and the other is located in a different position and cooled by a separate fan. However, it is preferable that the heat exchanger 91 should include both the radiator 91*a* and the oil cooler 91*b*, in the respect that one fan 92 can cool both the radiator 91*a* and the oil cooler 91*b* simultaneously (efficiently).

The above hydraulic oil tank 74 is located forward of the cooling device 90 on the swivel frame 42. Then, on the swivel frame 42, and between the cooling device 90 and the hydraulic oil tank 74, the electric motor 61 and hydraulic pump 71 are located. The electric motor 61 is supported on the swivel frame 42 by the motor support portion 100. The hydraulic excavator 1 is equipped with the motor support portion 100 that supports the electric motor 61 on the swivel frame 42 as a machine body frame. Details of the motor support portion 100 are to be described below.

Figure 5:
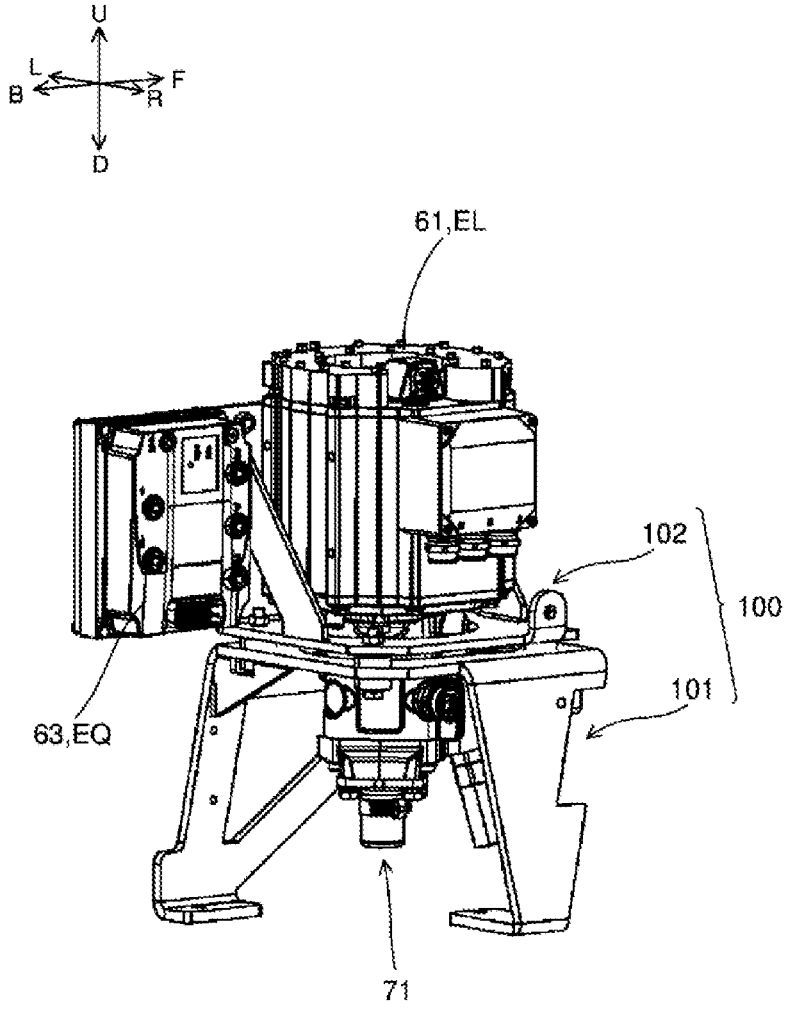
FIG. 5 is a perspective view of a motor support portion with the electric motor being supported.
Figure 6:
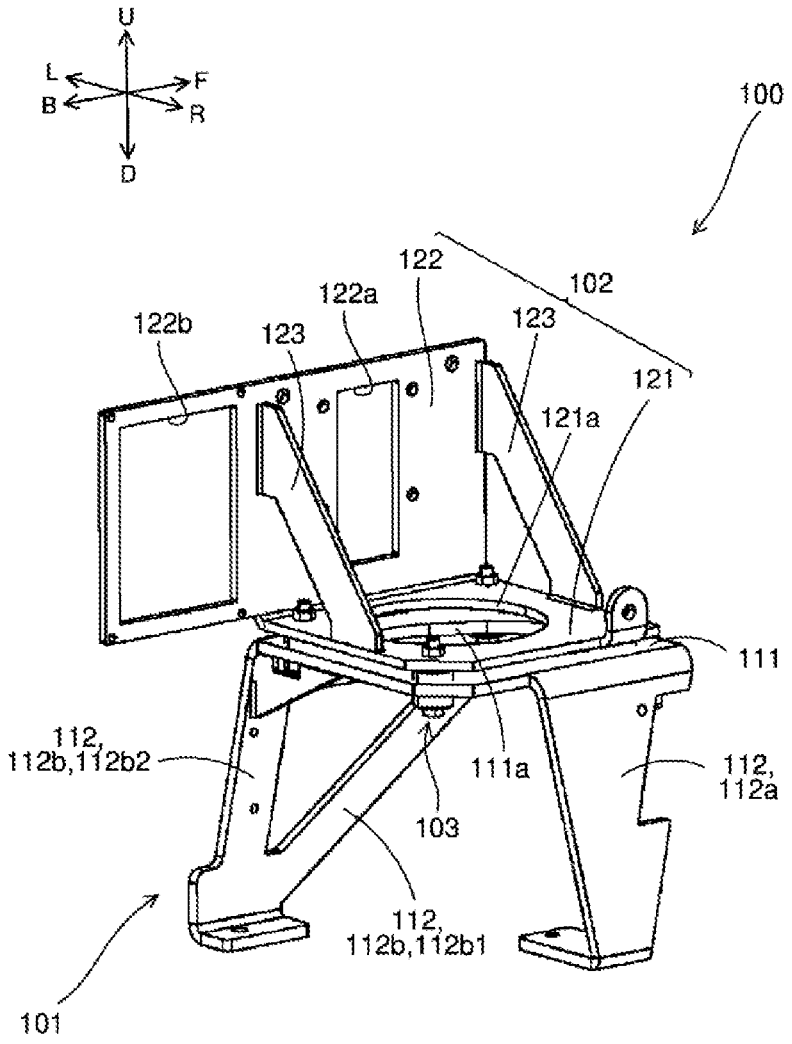
FIG. 6 is a perspective view of the motor support portion alone.

FIG. 5 shows a perspective view of the motor support portion 100 with the electric motor 61 being supported. Also, FIG. 6 is a perspective view of the motor support portion 100 alone. The motor support portion 100 has a first support portion 101 and a second support portion 102. With bolts and nuts (hereinafter referred to as "bolts, etc."), the first support portion 101 is attached to the swivel frame 42 (see FIG. 4) as the machine body frame. The second support portion 102 is located above the first support portion 101 and supports the electric motor 61. With a fastener 103, the second support portion 102 is attached to the first support portion 101. This allows the second support portion 102 to be supported by the first support portion 101. The fasteners 103 include, for example, bolts, nuts, and anti-vibration rubber.

The first support portion 101 has an upper plate portion 111, a leg portion 112. The upper plate portion 111 is a flat plate extending in the left-right and front-back directions, and, on the inside thereof, has an upper plate opening portion 111*a* through which the hydraulic pump 71 (see FIG. 5) passes.

The leg portion 112 includes a first leg portion 112*a* and a second leg portion 112*b*. The first leg portion 112*a* is connected to the right side edge portion of the upper plate portion 111, is narrower downward in width in the front-back direction, and has a lower end portion bending to the left side. The lower end portion of the first leg portion 112*a* is fixed to the swivel frame 42 with bolts or the like.

The second leg portion 112*b* has a front leg portion 112*b*1 and a back leg portion 112*b*2. Upper end portions of the front leg portion 112*b*1 and the back leg portion 112*b*2 are connected to the front and back of the left side edge portion of the upper plate portion 111, respectively. The front leg portion 112*b*1 and the back leg portion 112*b*2 narrow their distance from each other downward and meet (merge) in one place. Lower end portions of the front leg portion 112*b*1 and back leg portion 112*b*2, that is, merging end portions are bent to the right, and fixed to the swivel frame 42 with bolts or the like. This attaches the first support portion 101 to the swivel frame 42.

The second support portion 102 has a bottom plate portion 121, and a fixing plate portion 122. The bottom plate portion 121 is a flat plate extending in the left-right and front-back directions, and, on the inside thereof, has a bottom plate opening portion 121*a* through which the hydraulic pump 71 (see FIG. 5) passes.

The fixing plate portion 122 is a flat plate caused to stand on the left edge portion of the bottom plate portion 121. The angle defined between the bottom plate portion 121 and the fixing plate portion 122 is substantially 90°. The electric motor 61 (see FIG. 5) is fixed to the fixing plate portion 122 with bolts or the like.

With the electric motor 61 fixed to the fixing plate portion 122, the output shaft of the electric motor 61 is located along the vertical direction. That is, the electric motor 61 is fixed to the fixing plate portion 122 with the output shaft facing up and down. The electric motor 61 is fixed to the fixing plate portion 122 in a manner to be located above the bottom plate portion 121. Therefore, with the electric motor 61 fixed to the fixing plate portion 122, the bottom plate portion 121 is located lower than the electric motor 61. That is, the motor support portion 100 has the bottom plate portion 121 located below the electric motor 61.

The fixing plate portion 122 extends backward (cooling device 90 side) from the bottom plate portion 121. To the fixing plate portion 122's portion that protrudes backward from the bottom plate portion 121, the inverter 63 as an electric component EQ is attached with bolts or the like. Thus, in the fixing plate portion 122, the electric component EQ is located alongside the electric motor 61 in the front-back direction. The fixing plate portion 122 is located between the electric motor 61 and the battery unit 53 (see FIG. 9).

As shown in FIG. 6, the fixing plate portion 122 has a first opening portion 122*a* and a second opening portion 122*b* provided alongside the front-back direction. The first opening portion 122*a* and the second opening portion 122*b* are openings for heat dissipation of the electric motor 61 and inverter 63, and are formed corresponding to positions of mounting the electric motor 61 and the inverter 63.

The electric component EQ to be fixed to the fixing plate portion 122 is not limited to the inverter 63, and may be, for example, the DC-DC converter 66 (see FIG. 2). However, since the inverter 63 supplies a high voltage to the electric motor 61, it is preferable to place the inverter 63 and the electric motor 61 together (close to each other) so as to facilitate the arrangement of these connecting cables.

Reinforcing members 123 are provided at the front and back edges of the bottom plate portion 121. Each reinforcement member 123 extends diagonally leftward and upward from the bottom plate portion 121, and has an end connected to the fixing plate portion 122, respectively. This reinforces the fixing plate portion 122 to the bottom plate portion 121.

Figure 7:
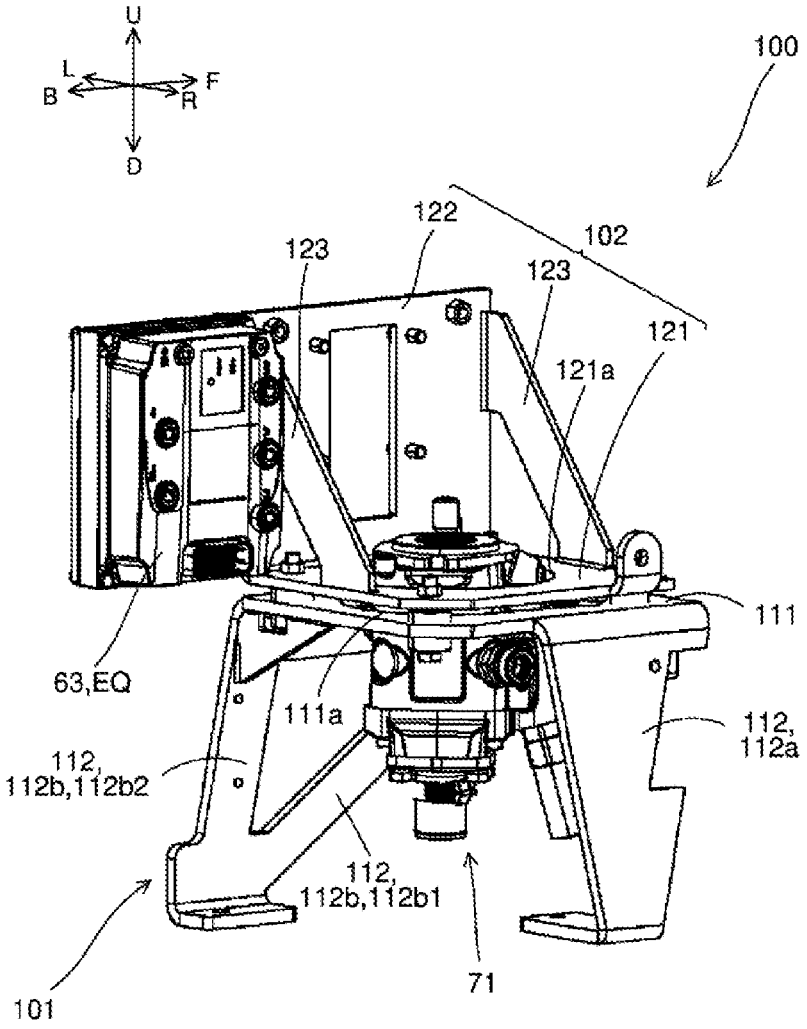
FIG. 7 is a perspective view showing the positional relationship between a hydraulic pump and the motor support portion.

FIG. 7 is a perspective view showing the positional relationship between the hydraulic pump 71 and the motor support portion 100. For convenience, FIG. 7 omits the electric motor 61 to which the hydraulic pump 71 is connected. Penetrating through the bottom plate opening portion 121*a* and the upper plate opening portion 111*a* of the motor support portion 100, the hydraulic pump 71 is connected to the electric motor 61. Since the output shaft of the electric motor 61 is along the vertical direction as described above, the input shaft of the hydraulic pump 71, which is connected to the output shaft, is also along the vertical direction. The hydraulic pump 71 is not supported by the motor support portion 100, but is connected (directly) to the electric motor 61 and suspended in midair. A support member to support the hydraulic pump 71 on the swivel frame 42 may be separately provided.

Mounting the electric motor 61 to the swivel frame 42 using the motor support portion 100 is performed, for example, in the following procedure. (1) The output shaft of the electric motor 61 is connected to the input shaft of the hydraulic pump 71 via a coupling (not shown). (2) Pass the hydraulic pump 71 through the bottom plate opening portion 121*a*, and then attach the electric motor 61 attached to the fixing plate portion 122 with bolts, etc. (3) Attach the inverter 63 to the fixing plate portion 122 with bolts or the like. (4) With a fastener 103, connect the second support portion 102 and the first support portion 101. At this time, the hydraulic pump 71 is located in a manner to pass through the upper plate opening portion 101*a* of the first support portion 101. (5) Fix the lower end portion of the first support portion 101 to the swivel frame 42 with bolts, etc. The order of (2) and (3) may be reversed. Also, the order of (4) and (5) may be reversed.

Figure 8:
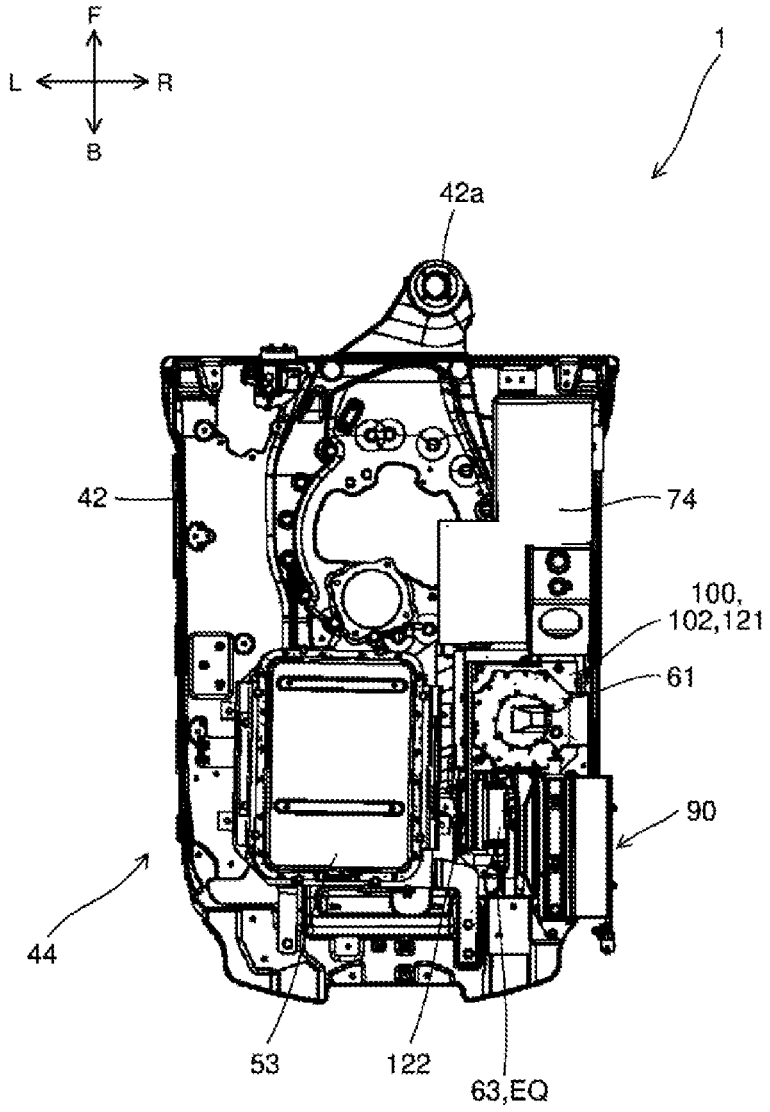
FIG. 8 is a plan view showing the configuration of the main portion in the engine chamber.
Figure 9:
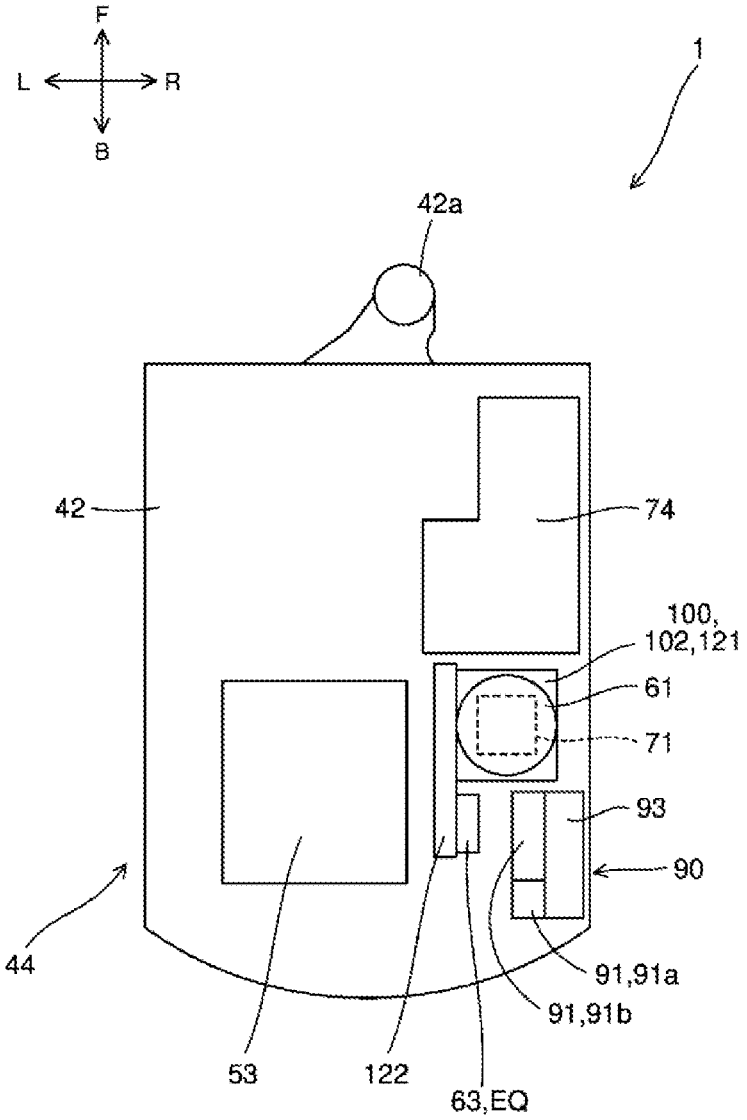
FIG. 9 is a schematic plan view of the configuration of the main portion.

FIG. 8 is a plan view showing the configuration of the main portion in the engine chamber 44 of the hydraulic excavator 1. FIG. 9 is a schematic plan view of the configuration in FIG. 8. As shown in these figures, the electric motor 61 and cooling device 90 are located beside the battery unit 53. In the present embodiment, on the right side of the battery unit 53, the electric motor 61 is located forward of the cooling device 90. That is, the electric motor 61 and the cooling device 90 are located beside the battery unit 53, offset in the front-back direction.

In the above locating of the electric motor 61 and the cooling device as shown in FIG. 9, the cooling device 90 can be positioned behind the electric motor 61 and in a manner to overlap the installation width of the electric motor 61 in the left-right direction. This allows both (simultaneously) the electric motor 61 and the cooling device 90 to be located closer to the battery unit 53. Therefore, even when the cooling device 90 is to be mounted on the small electric hydraulic excavator 1, the battery unit 53, the cooling device 90, and the electric motor 61 can be compactly (consolidated) located, making it possible to realize a layout preferable for the small electric hydraulic excavator 1. Since at least one of the refrigerant and hydraulic oil is cooled by the cooling device 90, the above effect can be obtained while ensuring good working performance of the hydraulic excavator 1.

In particular, from the viewpoint of ensuring that the width of the hydraulic excavator 1 (width in the left-right direction) is prevented from increasing; as in the present embodiment, it is preferable that the electric motor 61 and the cooling device 90, beside the battery unit 53, should be located in the front-back direction.

For example, on the swivel frame 42, the battery unit 53 may be positioned offset to the right side of the center in the left-right direction. In this case, the electric motor 61 and cooling device 90 may be located on the left side of the battery unit 53, offset in the front-back direction.

From the viewpoint of securing a flow path for air flow to cool the heat exchanger 91 of the cooling device 90, whether the sucking or discharging type, as shown in FIG. 4, it is preferable that the air vent 93*a* of the fan shroud 93 should be located opposite the battery unit 53 with respect to the heat exchanger 91. That is, this configuration, whether the sucking or discharging type, ensures, beside the battery unit 53, the flow path for airflow to cool the heat exchanger 91, making it possible to reliably cool the heat exchanger 91.

Particularly, in the configuration where the electric motor 61 is cooled by the refrigerant; from the viewpoint of obtaining the effect of the present embodiment described above, it is preferable that the electric instrument EL through which the refrigerant passes should include the electric motor 61.

In addition, in a configuration where the electric component EQ such as the inverter 63, that is, the electric component EQ that is supplied with power from the battery unit 53 is water-cooled; from the viewpoint of obtaining the above effect of the present embodiment, it is preferable that the electric instrument EL through which the refrigerant passes includes the above electric component EQ.

As shown in FIG. 9, from the viewpoint of effectively utilizing the space between the battery unit 53 and the cooling device 90, it is preferable that the electric component EQ should be located between the battery unit 53 and the cooling device 90. The above locating of the electric component EQ is also preferable in that the airflow generated by the fan 92 of the cooling device 90 can be applied to the electric component EQ and used effectively for air cooling of the electric component EQ. As described above, because the electric motor 61 and the cooling device 90 are located offset from each other in the front-back direction, there is almost no risk that the electric component EQ, which is located between the cooling device 90 and the battery unit 53, should interfere with the electric motor 61 located in front of the cooling device 90.

From the viewpoint of shortening the cable that connects the electric motor 61 and the electric component EQ and of facilitating the arrangement of the cable, it is preferable to locate the electric component EQ near the electric motor 61. To facilitate the above locating, it is preferable that the electric component EQ should be, beside the battery unit 53, located alongside the electric motor 61 in the front-back direction. In the present embodiment, as shown in FIG. 9; on the right side of the battery unit 53, the inverter 63 as the electric component EQ is located more backward than the electric motor 61, and is located alongside the electric motor 61 in the front-back direction.

In the present embodiment, the electric component EQ includes the inverter 63. In this configuration, the refrigerant passing through the inverter 63 is cooled by the cooling device 90. Therefore, the effect of the present embodiment described above can be obtained in a configuration where the inverter 63 is water-cooled.

In terms of preventing an increase in the width of the hydraulic excavator 1 and contributing significantly to the realization of the small hydraulic excavator 1, it is preferable that the hydraulic oil tank 74 should be located alongside the electric motor 61 in the front-back direction, as shown in FIG. 9. It is also preferable that the hydraulic oil tank 74 should be located alongside the hydraulic pump 71 in the front-back direction.

In particular, from the viewpoint of effectively utilizing the space in front of the electric motor 61, i.e., the space opposite the cooling device 90 with respect to the electric motor 61, the hydraulic oil tank 74 should be located opposite the cooling device 90 with respect to the electric motor 61, as shown in FIG. 9. From the same viewpoint, it is preferable that the hydraulic oil tank 74 should be located opposite the cooling device 90 with respect to the hydraulic pump 71.

As shown in FIG. 5, in the present embodiment, the electric motor 61 is located above relative to the hydraulic pump 71. That is, the electric motor 61 and hydraulic pump 71 are vertically located alongside. In the above locating; compared to a configuration in which, for example, the electric motor 61 and hydraulic pump 71 are located alongside the left-right direction (transversely mounted configuration), the total space occupied by the electric motor 61 and hydraulic pump 71 can be reduced when viewed from above. In other words, as shown in FIG. 9, the hydraulic pump 71 can be positioned within the space occupied by the electric motor 61 on the swivel frame 42, which means that the total occupied space of the electric motor 61 and hydraulic pump 71 is smaller than that in the transversely mounted configuration. This means that the installation space for the battery unit 53 can be expanded transversely compared to the transversely mounted configuration. Therefore, even the electric hydraulic excavator 1 being small can be equipped with the battery unit 53 being large (the battery unit 53 with sufficient capacity), making it possible to extend the operating time of the hydraulic excavator 1; in this respect, the layout in which the electric motor 61 and hydraulic pump 71 are located alongside vertically is very effective.

When the electric motor 61 and the hydraulic pump 71 are vertically located alongside, the output shaft of the electric motor 61 and the input shaft of the hydraulic pump 71 need not be vertically located alongside. For example, it may be so configured that the hydraulic pump 71 is located below the electric motor 61, and the output shaft of the electric motor 61 and the input shaft of the hydraulic pump 71 are each located in a manner to extend horizontally, and a power transmission mechanism having a shaft, a gear, etc. is interposed between the output shaft and the input shaft. In this configuration, power is transmitted from the electric motor 61 via the power transmission mechanism to the hydraulic pump 71, thereby to drive the hydraulic pump 71.

The description has been made with the hydraulic excavator 1, which is a construction machine, as the example of the electric work machine, but the electric work machine is not limited to the hydraulic excavator 1 and may be any other construction machine such as a wheel loader, or a compact truck loader. Also, the electric work machine may be an agricultural machine such as a combine harvester, and a tractor.

4. Appendices

The hydraulic excavator 1 described in the present embodiment can also be expressed as an electric work machine as shown in the following Appendix.

An electric work machine of an appendix (1) includes: an electric motor, an energy storage device that stores electric power to drive the electric motor, a hydraulic pump that is driven by the electric motor and discharges a hydraulic oil, and an electric instrument through which a refrigerant passes, wherein the electric work machine further comprises a cooling device that cools at least one of the hydraulic oil and the refrigerant, and the electric motor and the cooling device are located beside the energy storage device.

The electric work machine of an appendix (2); in the electric work machine according to appendix (1), the electric motor and the cooling device are, beside the energy storage device, located alongside in a front-back direction.

The electric work machine of an appendix (3); in the electric work machine according to any of appendix (1) or (2), a heat exchanger that cools, by heat exchange, at least one of the refrigerant and the hydraulic oil, and a fan that generates airflow across the heat exchanger, and a fan shroud having an air vent, and the fan shroud is located opposite the energy storage device with respect to the heat exchanger. The fan shroud is located on the opposite side of the heat exchanger from the energy storage device.

The electric work machine of an appendix (4); in the electric work machine according to any of appendices (1) to (3), the electric instrument includes the electric motor.

The electric work machine of an appendix (5); in the electric work machine according to any of appendices (1) to (4), the electric instrument includes an electric component that is supplied with the power from the energy storage device.

The electric work machine of an appendix (6); in the electric work machine according to appendix (5), the electric component is located between the energy storage device and the cooling device.

The electric work machine of an appendix (7); in the electric work machine according to appendix (5) or (6), the electric component is, beside the energy storage device, located alongside the electric motor in a front-back direction.

The electric work machine of an appendix (8); in the electric work machine according to any of appendices (5) to (7), the electric component includes an inverter.

The electric work machine of an appendix (9); in the electric work machine according to any of appendices (1) to (8), further comprising: a hydraulic oil tank that contains the hydraulic oil, the hydraulic oil tank is located alongside the electric motor in a front-back direction.

The electric work machine of an appendix (10); in the electric work machine according to appendix (9), the hydraulic oil tank is located opposite the cooling device with respect to the electric motor.

The electric work machine of an appendix (11); in the electric work machine according to any of appendix (9) or (10), the hydraulic oil tank is located alongside the hydraulic pump in the front-back direction.

The electric work machine of an appendix (12); in the electric work machine according to appendix (11), the hydraulic oil tank is located opposite the cooling device with respect to the hydraulic pump.

The electric work machine of an appendix (13); in the electric work machine according to any of appendices (1) to (12), the electric motor and the hydraulic pump are vertically located alongside.

The embodiment of the present invention has been described above, but the scope of the present invention is not limited thereto and can be carried out within an extended or modified range without departing from the gist of the present invention.

INDUSTRIAL APPLICABILITY

The present invention is applicable to work machines such as a construction machine and an agricultural machine, for example.

REFERENCE SIGNS LIST

1 hydraulic excavator (electric work machine)
53 battery unit (energy storage device, electric instrument)
61 electric motor (electric instrument)
63 inverter (electric instrument, electric component)
66 DC-DC converter (electric component)
71 hydraulic pump
74 hydraulic oil tank
90 cooling device
91 heat exchanger
91*a* radiator (heat exchanger)
91*b* oil oil cooler (heat exchanger)
92 fan
93 fan shroud
93*a* air vent
EL electric instrument
EQ electric component

The invention claimed is:

1. An electric work machine comprising:
an electric motor;
an energy storage device that stores electric power to drive the electric motor;
a hydraulic pump that is driven by the electric motor and discharges a hydraulic oil; and
an electric instrument through which a refrigerant passes, wherein
the electric work machine further comprises a cooling device that cools at least one of the hydraulic oil and the refrigerant, and
the electric motor and the cooling device are located beside the energy storage device, wherein the electric motor is located closer to the energy storage device than the cooling device.

2. The electric work machine according to claim 1, wherein the cooling device includes
a heat exchanger that cools, by heat exchange, at least one of the refrigerant and the hydraulic oil, and
a fan that generates airflow across the heat exchanger, and
a fan shroud having an air vent, and the fan shroud is located opposite the energy storage device with respect to the heat exchanger.

3. The electric work machine according to claim 1, wherein the electric instrument includes the electric motor.

4. The electric work machine according to claim 1, wherein the electric instrument includes an electric component that is supplied with the power from the energy storage device.

5. The electric work machine according to claim 4, wherein the electric component is located between the energy storage device and the cooling device.

6. The electric work machine according to claim 4, wherein the electric component is, beside the energy storage device, located alongside the electric motor in a front-back direction.

7. The electric work machine according to claim 4, wherein the electric component includes an inverter.

8. The electric work machine according to claim 1, further comprising:
a hydraulic oil tank that contains the hydraulic oil,
wherein the hydraulic oil tank is located alongside the electric motor in a front-back direction.

9. The electric work machine according to claim 8, wherein the hydraulic oil tank is located opposite the cooling device with respect to the electric motor.

10. The electric work machine according to claim 8, wherein the hydraulic oil tank is located alongside the hydraulic pump in the front-back direction.

11. The electric work machine according to claim 10, wherein the hydraulic oil tank is located opposite the cooling device with respect to the hydraulic pump in a front-back direction of the electric work machine.

12. The electric work machine according to any one of claim 1, wherein the electric motor and the hydraulic pump are vertically located.

13. An electric work machine comprising:
an electric motor;

an energy storage device that stores electric power to drive the electric motor;

a hydraulic pump that is driven by the electric motor and discharges a hydraulic oil; and an electric instrument through which a refrigerant passes, wherein the electric work machine further comprises a cooling device that cools at least one of the hydraulic oil and the refrigerant, and the electric motor and the cooling device are arranged in a mutually front-back relationship on opposite sides of the energy storage device, wherein the electric motor is located closer to the energy storage device than the cooling device.

* * * * *